United States Patent [19]

Thompson

[11] 4,190,043

[45] Feb. 26, 1980

[54] MASSAGE TABLE DRIVE SYSTEM

[76] Inventor: Terry D. Thompson, 2205 W. 8th St., Coffeyville, Kans. 67337

[21] Appl. No.: 937,207

[22] Filed: Aug. 28, 1978

[51] Int. Cl.[2] ..... A61H 1/00

[52] U.S. Cl. ..... 128/33; 128/52; 128/57

[58] Field of Search ..... 128/33, 51, 52, 57, 128/58, 24.1, 24.2, 24.3; 74/37

[56] References Cited

U.S. PATENT DOCUMENTS

| | | | |
|---|---|---|---|
| 2,884,923 | 5/1959 | Buffalow | 128/57 |
| 3,322,116 | 5/1967 | Murphy et al. | 128/52 |
| 3,446,205 | 5/1969 | Minohara | 128/57 |
| 3,830,233 | 8/1974 | Hill | 128/52 |
| 3,882,856 | 5/1975 | Heuser et al. | 128/57 |
| 4,071,021 | 7/1976 | Gallacci | 128/52 |
| 4,085,738 | 4/1978 | Kodera | 128/52 |

*Primary Examiner*—Lawrence W. Trapp
*Attorney, Agent, or Firm*—William S. Dorman

[57] ABSTRACT

An improved drive system for a massage table that includes a cabinet housing having an open top area, massage means that are formed to the housing and a lounge top having an upper side to support a patient and a lower side. The drive system comprises a motor within the housing, gear reduction means connected to the motor, and a continuous chain moved by the gear reduction means such that the path of the chain forms a plane. An upwardly extending ear link in the chain acts as a driver for the lounge top and a transverse bracket slot on the lower side of the top is capable of receiving the ear link. Removable parallel drill rods extend longitudinally across and are spaced from the lower side of the lounge top. Security brackets extend from the open top area of the housing with each bracket having an opening to accept a drill rod therethrough. Casters extend from the open top area and are aligned in a plane parallel to the path of the chain to allow the table top to slide reciprocally longitudinally.

3 Claims, 4 Drawing Figures

MASSAGE TABLE DRIVE SYSTEM

BACKGROUND OF THE INVENTION

1. Field of the Invention

This invention relates to an improved drive system for massage tables that stimulate circulation or make muscles or joints supple in parts of the human body.

2. Description of the Prior Art

Various motorized massage mechanisms are known. Frequently, a flat lounge top is utilized to support a prone human body and the lounge top is moved back and forth longitudinally over the generally stationary massage mechanism. Different areas of the body are thus alternately subjected to the massage mechanism.

The lounge top should be secured to the massage mechanism and be capable of supporting the weight of a human body. It is desirable to move the lounge top very slowly back and forth past the massage mechanism at an even rate of speed.

Therefore, it is a principal object and purpose of the present invention to provide a drive system for mechanized massage tables that will operate to move the lounge top reciprocally at a slow, even rate of speed.

It is also an object and purpose of the present invention to provide an improved method of attachment of the lounge top to the mechanized massage table to provide a secure attachment yet allow movement of the lounge top thereon.

It is a further object and purpose of the present invention to provide a massage table drive system that is simple in design and economical to manufacture.

SUMMARY OF THE INVENTION

The present invention provides an improved drive system for massage tables to stimulate circulation or make muscles or joints supple in parts of the human body.

A massage unit is mounted on a rigid suspension board which is hingedly connected to the interior of a cabinet. An adjustable motor mount bracket has an electric gear motor attached and the bracket is formed to the suspension board. A motor sprocket is turned by a motor shaft extending from the gear motor. A massage sprocket, having the same axis of rotation as the motor sprocket, has a continuous chain that passes around the sprockets. The massage sprocket is rotatably mounted about a shaft on a pillow block. Freely rotatably mounted on the shaft is a pair of parallel triangular plates. Extending between the plates from each of the points of the triangular plates are grooved massage rollers.

The height of the entire massage unit is adjustable through use of a screw jack mounted on an inclined screw jack support attached to the interior of the cabinet. The screw jack has a handle that extends through an opening in a side of the cabinet.

The drive system is powered by an electric gear motor that turns a vertically extending drive shaft. The vertical placement of the motor eliminates the necessity for right angle motor drive. The drive shaft is aligned so that the axis of rotation of the drive shaft is parallel to the axis of rotation of a pair of gear reduction shafts. A drive sprocket is formed at the lower end of the drive shaft and a continuous chain passes around the drive sprocket and a lower sprocket formed on one of the gear reduction shafts.

A pair of upper sprockets are formed on the upper ends of the gear reduction shafts. A continuous upper chain passes around the upper sprockets. An upwardly extending ear link in the upper chain acts as the driver link for the drive system.

A plurality of casters extend upward from the cabinet near the open top. The casters are aligned such that a massage lounge top can slide longitudinally thereon. An opening in the lounge top accomodates a portion of the cylindrical path of the massage rollers.

A pair of parallel drill rods holds the lounge top in place. The end of each drill rod will fit within a notch or hole in edging which extends downward from the lounge top.

When the lounge top is in place atop the cabinet, the ear link will fit within a bracket slot on the underside of the lounge top. The width of the bracket slot will be wide enough to accomodate the movement of the ear link around the upper sprockets. Movement of the upper chain will force the lounge top to move longitudinally.

Activation of the massage unit and the drive system is through a series of rocker arm switches.

DETAILED DESCRIPTION OF THE PREFERRED EMBODIMENTS

Figure 2:
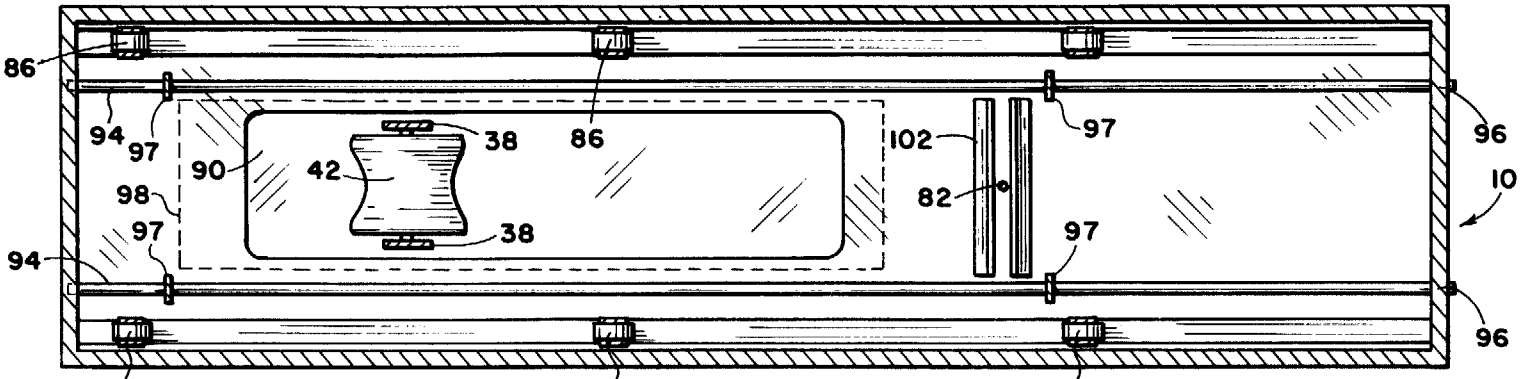
FIG. 2 is a sectional view of the massage table drive system as shown in FIG. 1 along section lines 2—2.

Referring to the drawings in detail as shown in FIGS. 1 through 4, the present invention provides an improved drive system for a massage table 10 to stimulate circulation or make muscles or joints supple in parts of the human body.

Figure 3:
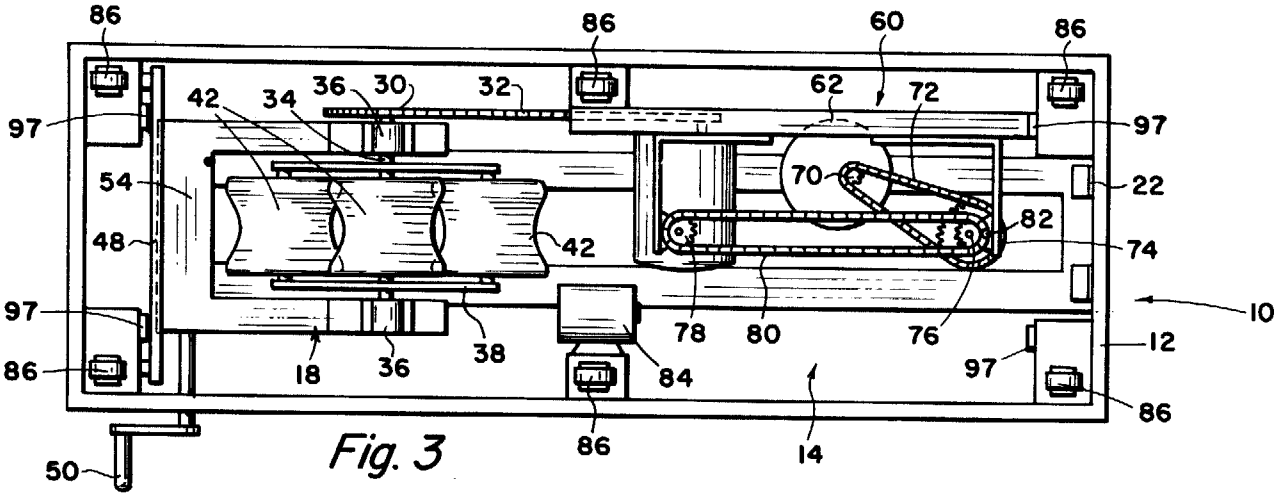
FIG. 3 is a top view of the massage table drive system as shown in FIG. 1 having the lounge top removed for clarity.
Figure 4:
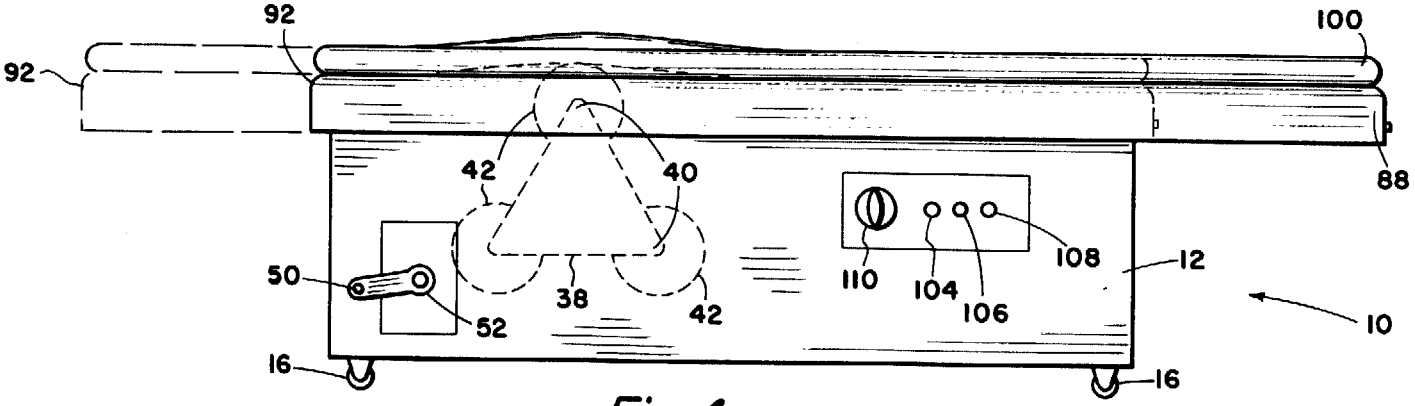
FIG. 4 is a plan view of the massage table drive system as shown in FIG. 1 wherein the dashed lines indicate the extent of longitudinal movement of the lounge top.

The massage table includes a cabinet 12 of any suitable type, such as a generally rectangular one having an open top 14 as best seen in FIG. 3. Floor casters 16 extend from the bottom of the cabinet to allow the massage table to be moved easily. It is to be understood that the cabinet itself forms no part of the present invention.

A massage unit 18 is mounted on a rigid suspension board 20 which is hingedly connected to the interior of the cabinet by hinges 22. An adjustable motor mount bracket 24, having an electric gear motor 26 thereon, is formed on the suspension board 20. The gear motor 26 turns a toothed motor sprocket 28 formed thereto. A massage sprocket 30, having the same axis of rotation as the motor sprocket, has a continuous chain 32 composed of links that pass between and around portions of the sprockets 28 and 30. The massage sprocket 30 is rotatably mounted about a shaft 34 on a pillow block 36. Freely rotatably mounted on the shaft 34 is a pair of triangular plates 38. The plates, each having three points 40, are aligned parallel to each other. Extending between the plates 38 from each of the points 40 of the triangular plates are grooved massage rollers 42. The three massage rollers are thus parallel to each other.

As will be seen, the massage rollers will alternately move toward the open top 14 of the cabinet toward a patient that will be lying on the massage table 10. When the plates are rotated, the path of the massage rollers 42 forms a large cylinder. Since the electric gear motor 26 is capable of turning the motor shaft 34 in either a clockwise or counterwise direction.

The height of the entire massage unit 18, including the position of the massage rollers 42, is adjustable through use of a screw jack 44 mounted on an incline screw jack support 46 that is attached to the interior of the cabinet. The elevation is limited by a restriction bar 48 that is formed to the interior of the cabinet. The screw jack has a handle 50 that extends through an opening 52 in a side of the cabinet 12. The jack is connected to the message unit 18 by a massage bracket 54. The massage unit can be raised or lowered through use of the crank handle. The raising or lowering of the massage unit will change the strength of the massage, the higher the unit, the stronger the massage. The use of the screw jack 44 thus allows the massage unit to be moved from a stationary pivot point at the hinges 22.

Figure 1:
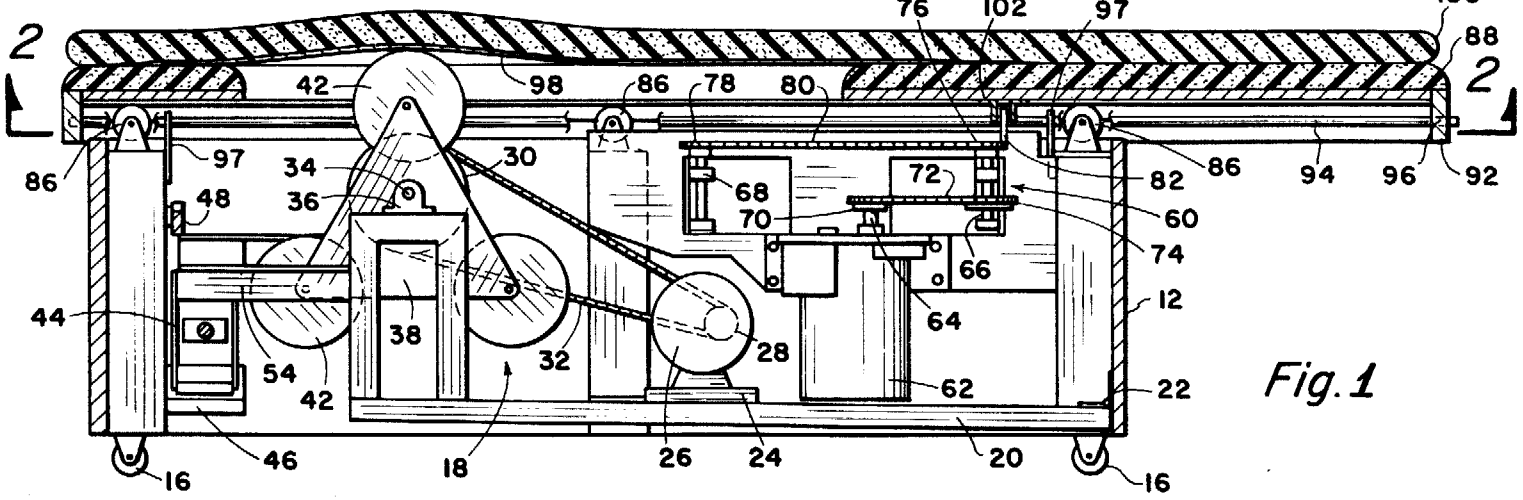
FIG. 1 is a sectional, plan view of a massage table having a drive system constructed in accordance with one embodiment of the present invention.

As best seen in FIGS. 1 and 3, the drive system 60 is powered by an electric gear motor 62 that turns a vertically extending drive shaft 64. It should be noted that the vertical placement of the motor eliminates the need for right angle drive. The drive shaft 64 is aligned so that the axis of rotation of the drive shaft is parallel to the axes of rotation of a pair of gear reduction shafts 66 and 68. A drive sprocket 70 is formed at the end of the drive shaft 64. A continuous lower chain 72, composed of links, passes between and around portions of the drive sprocket 70 and a lower sprocket 74 is formed on the gear reduction shaft 66.

A pair of upper sprockets 76 and 78 are formed on the upper ends of shafts 66 and 68 respectively. A continuous upper chain 80, composed of links, passes between and around portions of the upper sprockets 76 and 78. An upwardly extending ear link 82 in the upper chain 80 acts as the driver link for the drive system.

A conventional vibrator 84, known in the art, may be attached to the cabinet to vibrate the entire massage table.

A series of casters 86 extend upward from the cabinet near the open top 14. The casters are aligned such that a massage lounge top 88 can slide longitudinally thereon. The lounge top 88 is flat, generally rectangular in shape and of a size to support an inclined body. An opening 90 in the lounge top accomodates a portion of the cylindrical path of the massage rollers. At the longitudinal ends of the lounge top, edging 92 extends downward.

The massage unit is, therefore, generally stationary with the exception of the adjustment for height. The lounge top 88 is reciprocally moved longitudinally in relation to the cabinet 12 such that a human body (not shown) prone on the lounge top would have alternate parts of the body pass the massage rollers 42. A pair of parallel drill rods 94 holds the lounge top in place. The end of each drill rod will fit within a notch or hole 96 in the edging. The drill rods are removable and, when removed, the table top may be easily lifted off of the cabinet. Easy access is thus provided in the event that servicing is necessary.

Extending up from the cabinet 12 near the top area 14 are security brackets 97, each having a hole to allow a drill rod 94 to fit through. It is important to note that when the drill rods are in place through the security brackets 97, the lounge top is slidably secured to the cabinet 12.

Placed on the lounge top 88 is a rubber cover pad 98 over the opening 80. A form rubber cover 100 rests on the top of the lounge top.

When the lounge top is in place atop the cabinet, the ear link 82 will fit within a bracket slot 102 on the underside of the lounge top as best seen in FIG. 1. The bracket slot is transverse to the drill rods 94 and the movement of the lounge top. The width of the bracket slot will be wide enough to accomodate the movement of the ear link around the upper sprockets 76 and 78. Movement of the upper chain 80 will force the lounge top to move longitudinally.

The height of the massage unit 18 can be raised or lowered by turning the crank handle 50 that is connected to the screw jack 44. This will increase or decrease, respectively, the strength of the massage that is received by the patient.

Activation of the massage unit and the drive system is through rocker arm switches 104, 106 and 108 that are connected to the motors 26 and 62, and the vibrator 84, respectively. A timer 110 formed to the cabinet will operate the massage unit and the drive system and the vibrator for a predetermined period.

Although not shown, the massage table would be connected to a conventional, residential power source.

Whereas the present invention has been described in particular relation to the drawings attached hereto, it should be understood that other and further modifications of the invention, apart from those shown or suggested herein, may be made within the spirit and scope of this invention.

What is claimed is:

1. An improved drive system for a massage table which includes a cabinet housing having an open top area, massage means formed to said housing, and a massage table top having an upper side for allowing a patient to be supported thereon and a lower side and wherein said system comprises motor means formed within said housing; gear reduction means connected to and powered by said motor means; a continuous chain formed from a plurality of links moved by said gear reduction means such that the path of said chains forms a plane; an upwardly extending ear link in said chain to act as a driver for said table top; a transverse bracket slot on said lower side of said top for receiving said ear link therein; a plurality of removable parallel drill rods extending longitudinally across and spaced from said lower side; a plurality of security brackets extending from said open top area of said housing, each bracket having an opening to accept a drill rod therethrough; and a plurality of caster means extending from said open top area and aligned in a plane parallel to said plane of said chain to allow said table top to slide reciprocally longitudinally thereon.

2. An improved drive system for a massage table as set forth in claim 1 wherein said massage means includes reversible motor means having a drive shaft extending therefrom; a drive sprocket turned by said drive shaft; a massage wheel sprocket having the same axis of rotation as said drive sprocket; a continuous chain composed of links passing around said sprockets; a massage wheel shaft driven by said massage wheel sprocket; a pair of parallel plates mounted on said massage wheel sprocket; and a plurality of parallel massage rollers extending between said plates, whereby the path of said rollers about said massage wheel shaft is cylindrical.

3. An improved drive system for a massage table as set forth in claim 1 including vibrator means attached to said cabinet housing.

* * * * *